US006863510B2

(12) United States Patent
Cho

(10) Patent No.: US 6,863,510 B2
(45) Date of Patent: Mar. 8, 2005

(54) VACUUM PREVENTING OIL SEAL FOR SCROLL COMPRESSOR

(75) Inventor: Yang-Hee Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 29 days.

(21) Appl. No.: 10/338,724

(22) Filed: Jan. 9, 2003

(65) Prior Publication Data

US 2003/0206812 A1 Nov. 6, 2003

(30) Foreign Application Priority Data

May 1, 2002 (KR) ..... 10-2002-0023974

(51) Int. Cl.[7] ..... F04B 23/00; F04B 17/00; F01C 2/00; F16K 11/00; F15B 21/04

(52) U.S. Cl. ..... 417/440; 417/410.5; 418/55.1; 418/15; 137/246; 92/83

(58) Field of Search ..... 417/440, 410.5; 418/55.1, 15; 137/246, 282; 92/83; 277/412, 418, 904

(56) References Cited

U.S. PATENT DOCUMENTS 17,855 A * 7/1857 Gale ..... 277/303
2,753,892 A * 7/1956 Clinton et al. ..... 138/31
3,596,871 A * 8/1971 Rothrock ..... 251/3
4,294,161 A * 10/1981 Sheppard ..... 91/422
4,391,580 A * 7/1983 Hunsberger et al. ..... 431/1
4,690,625 A * 9/1987 Murayama et al. ..... 418/55.2
4,841,846 A * 6/1989 Grambling ..... 92/60
5,049,044 A * 9/1991 Hirano ..... 417/310

FOREIGN PATENT DOCUMENTS

JP 6-288361 * 10/1994 ..... F04C/18/02

OTHER PUBLICATIONS

Derwent Abstract 2002–088245; KR 2001076882 A, Aug. 17, 2001.*

* cited by examiner

*Primary Examiner*—Cheryl J. Tyler
*Assistant Examiner*—Timothy P. Solak
(74) *Attorney, Agent, or Firm*—Birch, Stewart, Kolasch & Birch, LLP

(57) ABSTRACT

Disclosed is a vacuum preventing device for a scroll compressor comprising: a chamber formed at one side of a fixed scroll and having a suction hole, a compression hole, and a discharge hole at an inner circumference surface thereof; an open/close member installed in the chamber and having a seal oil groove at an outer circumference surface thereof for selectively connecting the discharge hole to the suction hole; and an elasticity member installed in the chamber for providing an elasticity force to the open/close member. The device can enhance a compression efficiency of the compressor by preventing gas leakage efficiently and reduce a fabricating cost by improving a design of a clearance and enhancing a tolerance limit range.

10 Claims, 7 Drawing Sheets

VACUUM PREVENTING OIL SEAL FOR SCROLL COMPRESSOR

BACKGROUND OF THE INVENTION

1. Field of the Invention

The present invention relates to a scroll compressor, and more particularly, to a vacuum preventing device for a scroll compressor in which gas in a discharge region flows backward to a suction region at the time of an abnormal driving such as a pump down or an expansion valve blocking, thereby preventing a vacuum of the compressor.

2. Description of the Background Art

Generally, a compressor is a device for converting mechanical energy into latent energy of a compression fluid, and is largely classified into a reciprocation compressor, a scroll compressor, a centrifugal compressor, and a vane compressor by compression methods.

The scroll compressor has a structure that gas is sucked, compressed, and discharged by using a rotation member like the centrifugal type and the vane type differently from the reciprocating type which uses a linear reciprocation of an piston member.

FIG. 1 is a longitudinal sectional view showing an inner part of the conventional scroll compressor.

As shown, the scroll compressor comprises: a case 1 divided into a gas suction pipe SP and a gas discharge pipe DP; a main frame 2 and a sub frame (not shown) respectively installed at both sides of upper and lower portions of an inner circumference surface of the case 1; a driving motor 3 installed between the main frame 2 and the sub frame; a rotation shaft 4 engaged to a center portion of the driving motor 3 for transmitting a rotation force of the driving motor 3; an orbiting scroll 5 installed to have an eccentric rotation at an upper portion of the rotation shaft 4 and having a wrap 5*a* of an involute curve shape at the upper portion thereof; and a fixed scroll 6 engaged to the orbiting scroll 5, and having a wrap 6*a* of an involute curve shape so as to form a plurality of compression spaces P therein.

The case 1 is divided into a suction region S1 and a discharge region S2 by a high and low pressure separation plate 7, and a compression region S3 is formed at a position connected to the compression space P.

A gas inlet 6*b* and an outlet 6*c* are respectively formed at a lateral surface and a center portion of the fixed scroll 6, and a non-return valve 8 for preventing discharged gas from flowing backward is installed at an upper surface of the fixed scroll 6.

The main frame 2 and the sub frame are fixed to the inner circumference surface of the case 1 by a fixation means such as welding, and the fixed scroll 6 is also fixed to a bottom surface of the high and low pressure separation plate 7 by a fixation means such as a bolt.

Meantime, in case of a pump down and an expansion valve blocking, the suction region S1 of the compressor becomes a high vacuum state. At this time, components relevant to the compressor may be damaged and destroyed.

To prevent this, a vacuum preventing device 20 is provided in the conventional art.

FIG. 2 is a longitudinal sectional view showing an operation at the time of a normal driving in the vacuum preventing device of FIG. 1, FIG. 3 is a longitudinal sectional view showing an operation at the time of an abnormal driving in the vacuum preventing device of FIG. 1, and FIG. 4 is a sectional view taken along line A—A of FIG. 2.

Referring to FIGS. 2 and 3, the vacuum preventing device 20 includes a chamber 10 formed at one side of the fixed scroll 6, and a discharge hole 11 connected to the discharge region S2 at an upper surface of the chamber 10.

A compression hole 12 connected to the compression region S3 is formed at a bottom surface of the chamber 10, a plug 14 having a suction hole 13 is fixed to an opening portion of the chamber 10 by a fixation pin 15, and the suction hole 13 is connected to the discharge hole 11.

An open/close member 17 for selectively connecting the discharge hole 11 and the suction hole 13 is movably installed in the chamber 10.

A spring 16 for limiting a movement of the open/close member 17 and providing an elasticity force thereto is installed at the opening portion of the chamber 10.

Hereinafter, operations of the conventional scroll compressor will be explained.

First, when a power source is applied to the driving motor 3, the driving motor 3 rotates the rotation shaft 4, and the orbiting scroll 5 engaged to the rotation shaft 4 is rotated to an extent of its eccentric distance.

At this time, a plurality of compression spaces P formed between the wrap 5*a* of the orbiting scroll 5 and the wrap 6*a* of the fixed scroll 6 gradually move towards a center portion of the fixed scroll 6 as the orbiting scroll 5 continuously performs an orbiting movement, thereby having a decreased volume.

By the decreased volume of the compression spaces P, gas of the suction region S1 is sucked into the compression space P through the inlet 6*b*, and the sucked gas is discharged to the discharge region S2 through the outlet 6*c*.

When the compressor is normally driven, a pressure of the compression region is larger than an elasticity force of the spring 16, so that the open/close member 17 overcomes the elasticity force of the spring 16 and closes the discharge hole 11.

However, the compressor is abnormally driven, a pressure of the compression region is smaller than the elasticity force of the spring 16, so that the open/close member 17 is shoved by the elasticity force of the spring 16 and opens the discharge hole 11. At this time, the discharge hole 11 is connected to the suction hole 13.

As the discharge hole 11 and the suction hole 13 are connected to each other, gas of the discharge region S2 flows backward into the suction region S1 through the discharge hole 11 and the suction hole 13, thereby releasing a vacuum of the compressor.

As shown in FIG. 4, in the conventional scroll compressor, a minute clearance t is formed between an inner wall of the chamber 10 and an outer circumference surface of the open/close member 17 so as to induce a smooth slide movement of the open/close member 17.

Generally, the clearance is fabricated as the minimum size so that the open/close member 17 can slide the chamber 10, and fabricated as a minute size enough not to leak gas through the discharge hole 11 when the open/close member 17 closes the discharge hole 11.

When the clearance t becomes smaller, gas is closed more efficiently but an operation of the open/close member 17 is not smooth. On the contrary, when the clearance t becomes larger, gas leakage is increased and an operation of the open/close member 17 is smooth. Accordingly, considering the operation of the open/close member 17, the clearance t is designed and fabricated within a tolerance limit range.

However, in the conventional art, when the compressor is normally driven, the open/close member 17 receives a pressure downwardly by a gas pressure of the discharge region S2. At this time, a bottom surface of the open/close member 17 is adhered to an inner bottom surface of the chamber 10 and an upper surface of the open/close member 17 is more separated from an inner upper surface of the chamber 10. That is, the clearance t becomes large more than the tolerance limit range.

When the clearance t becomes large, a part of gas of the discharge region leaks to the suction region through the clearance, thereby degrading a compression efficiency of the compressor.

Also, in the conventional art, since high minuteness is required at the time of designing and fabricating the clearance, a high cost is required and a productivity is degraded.

SUMMARY OF THE INVENTION

Therefore, an object of the present invention is to provide a vacuum preventing device for a scroll compressor in which a seal oil groove is formed at an outer circumference surface of an open/close member which closes a discharge hole and oil always remains at the seal oil groove to fill a gas leakage hole (clearance), thereby efficiently preventing gas leakage at the time of a normal driving.

Another object of the present invention is to provide a vacuum preventing device for a scroll compressor in which a tolerance limit range of the clearance is wide in forming the clearance between a chamber and the open/close member, thereby enhancing a degree of freedom in designing and fabricating the clearance and reducing a fabricating cost.

To achieve these and other advantages and in accordance with the purpose of the present invention, as embodied and broadly described herein, there is provided a vacuum preventing device for a scroll compressor comprising: a chamber formed at one side of a fixed scroll and having a suction hole, a compression hole, and a discharge hole at an inner circumference surface thereof; an open/close member installed in the chamber and having a seal oil groove at an outer circumference surface thereof for selectively connecting the discharge hole to the suction hole; and an elasticity member installed in the chamber for providing an elasticity force to the open/close member.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Hereinafter, the vacuum preventing device for a scroll compressor according to one preferred embodiment of the present invention will be explained with reference to attached drawings.

Figure 1:
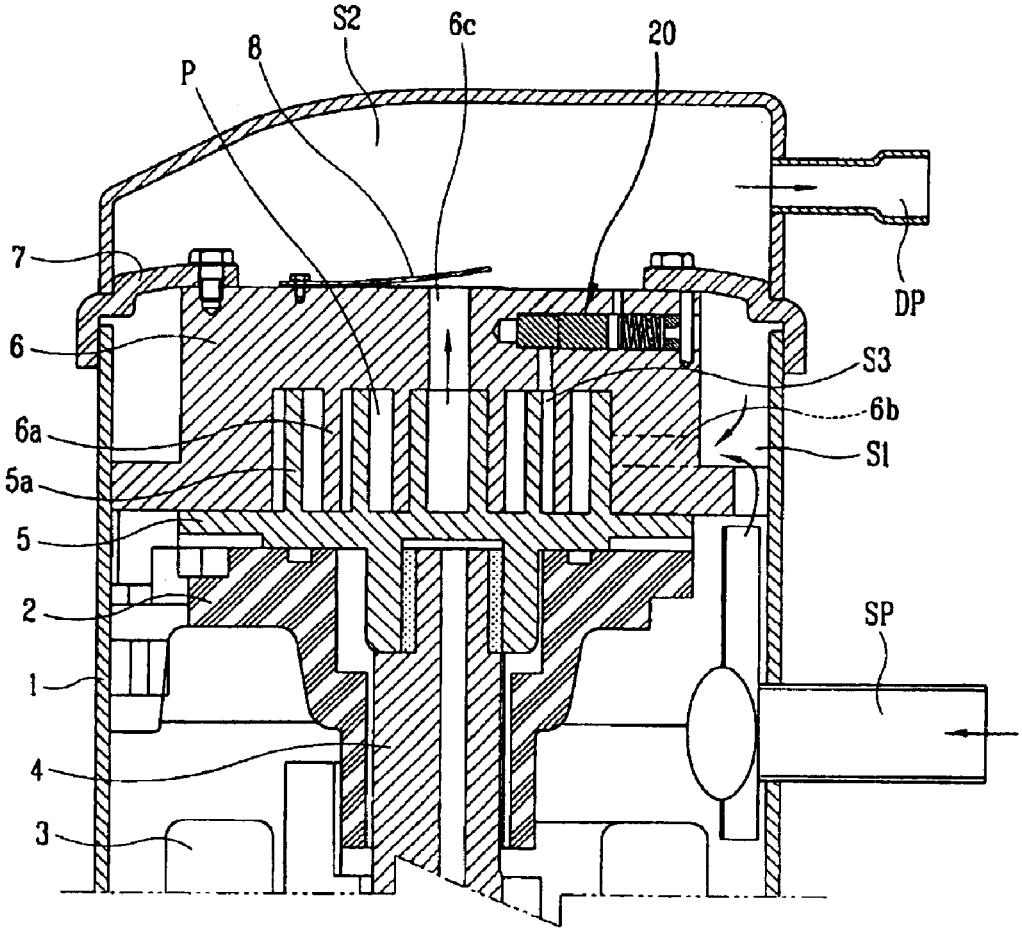
FIG. 1 CONVENTIONAL ART
FIG. 1 is a longitudinal sectional view showing an inner part of a conventional scroll compressor.
Figure 2:
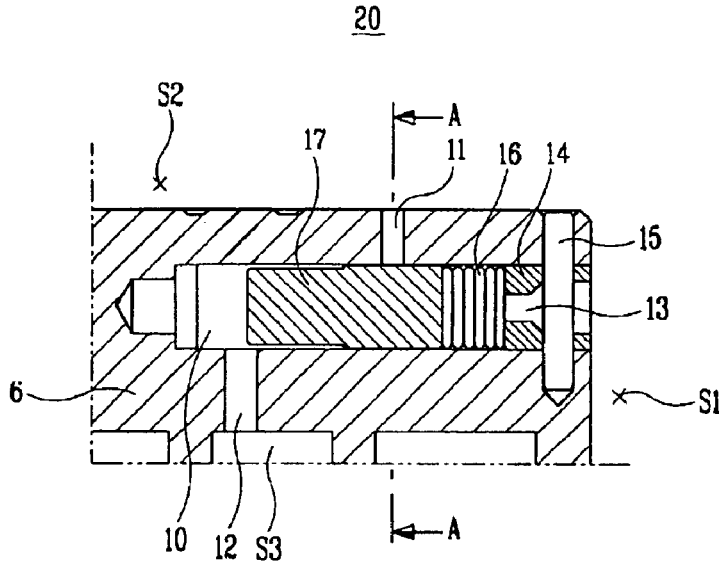
FIG. 2 CONVENTIONAL ART
FIG. 2 is a longitudinal sectional view showing an operation at the time of a normal driving in the vacuum preventing device of FIG. 1.
Figure 3:
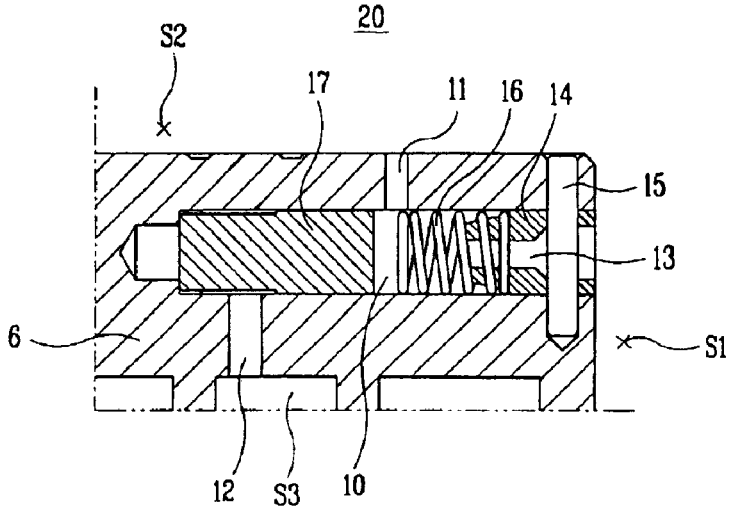
FIG. 3 CONVENTIONAL ART
FIG. 3 is a longitudinal sectional view showing an operation at the time of an abnormal driving in the vacuum preventing device of FIG. 1.
Figure 4:
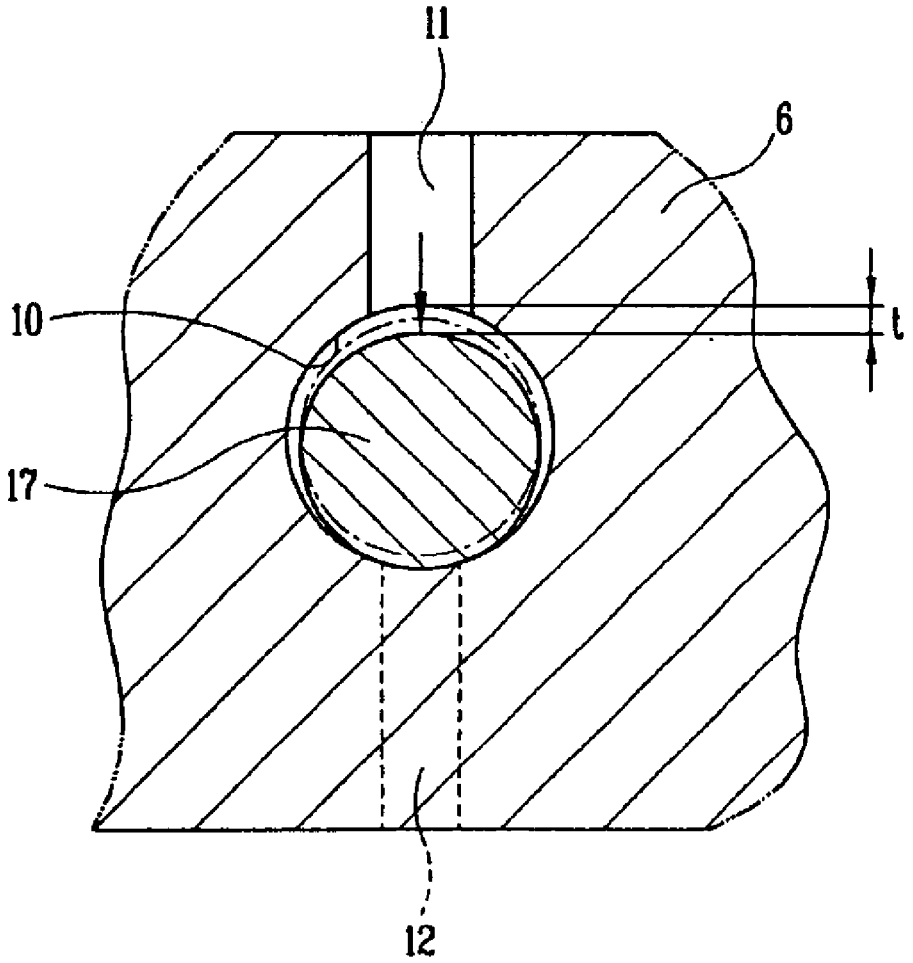
FIG. 4 CONVENTIONAL ART
FIG. 4 is a sectional view taken along line A—A of FIG. 2.
Figure 5:
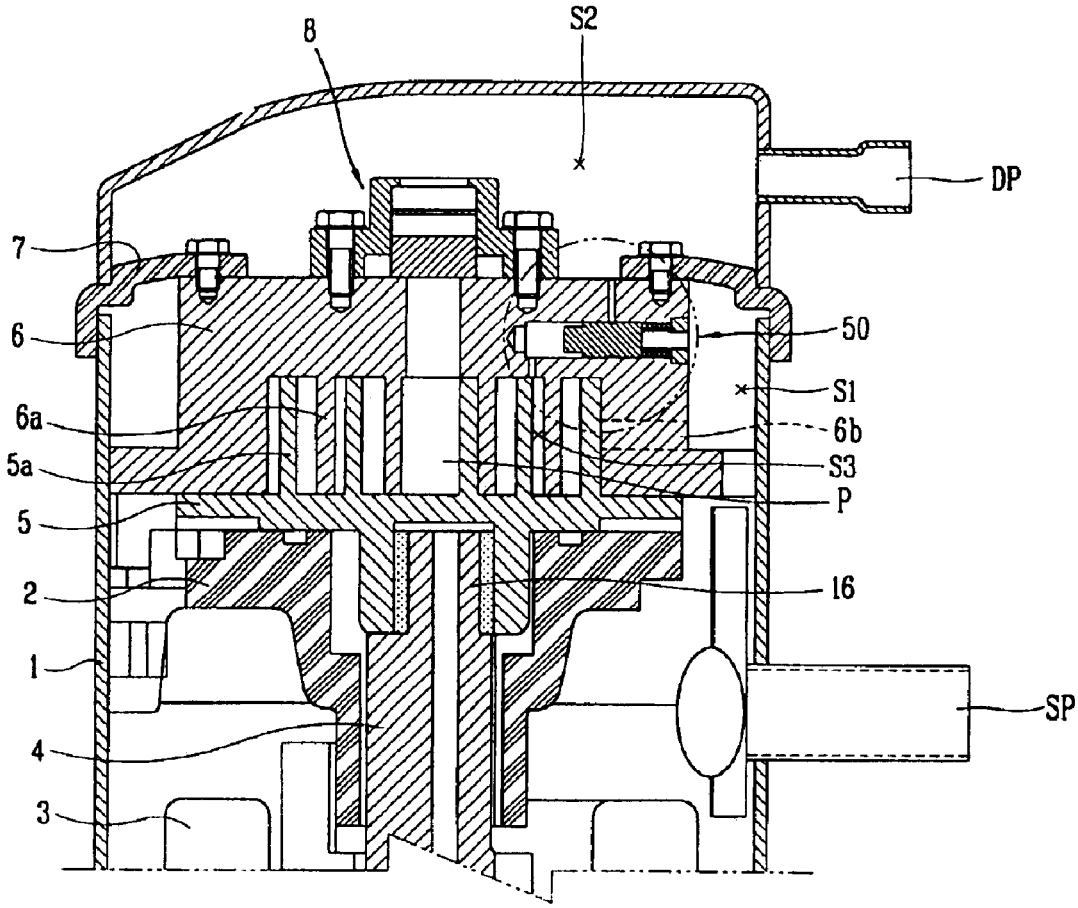
FIG. 5 is a longitudinal sectional view showing a scroll compressor according to the present invention.
Figure 6:
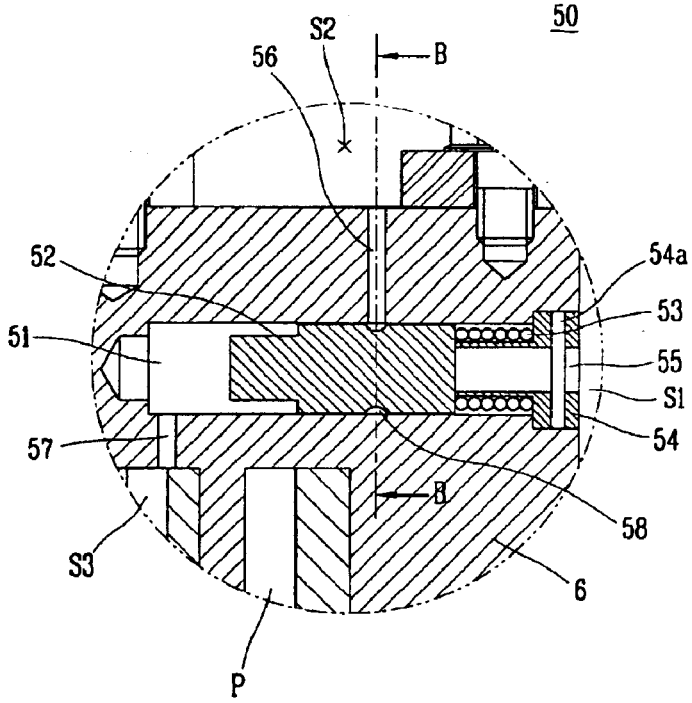
FIG. 6 is a longitudinal sectional view showing an operation of the vacuum preventing device when the compressor of FIG. 5 is normally driven.
Figure 7:
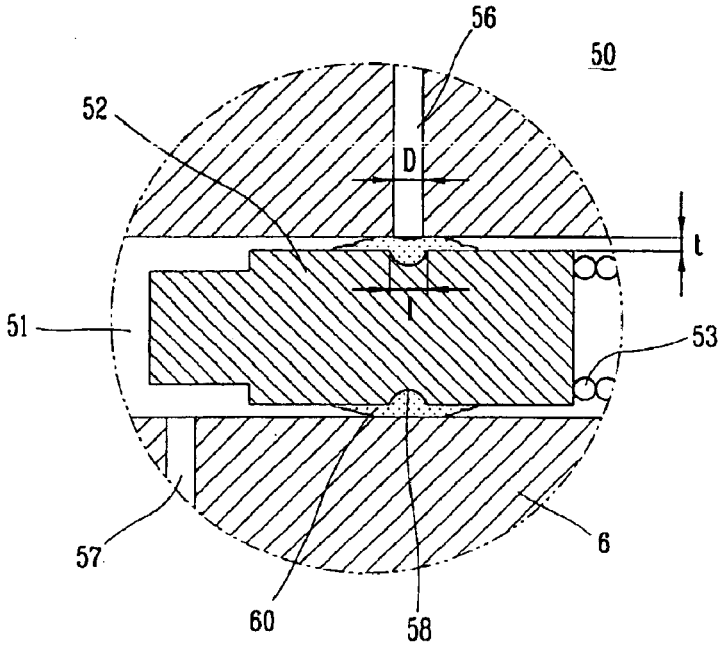
FIG. 7 is an enlargement view showing a clearance close state of FIG. 6.
Figure 8:
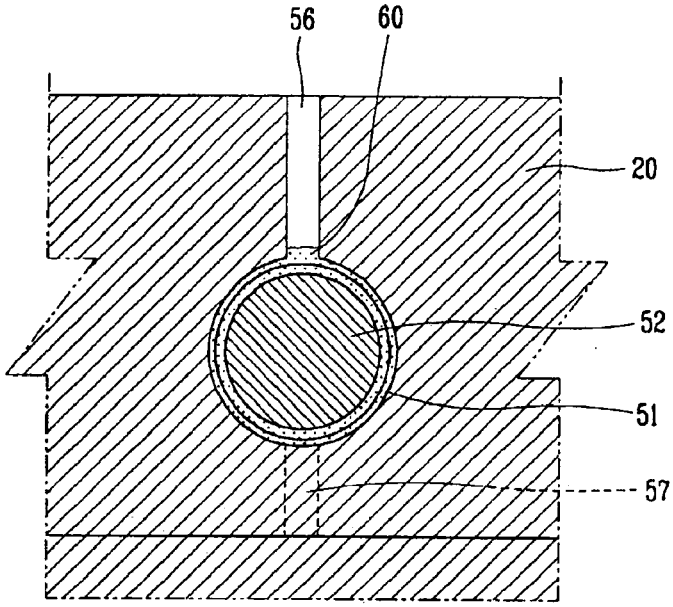
FIG. 8 is a sectional view taken along line B—B of FIG. 6.
Figure 9:
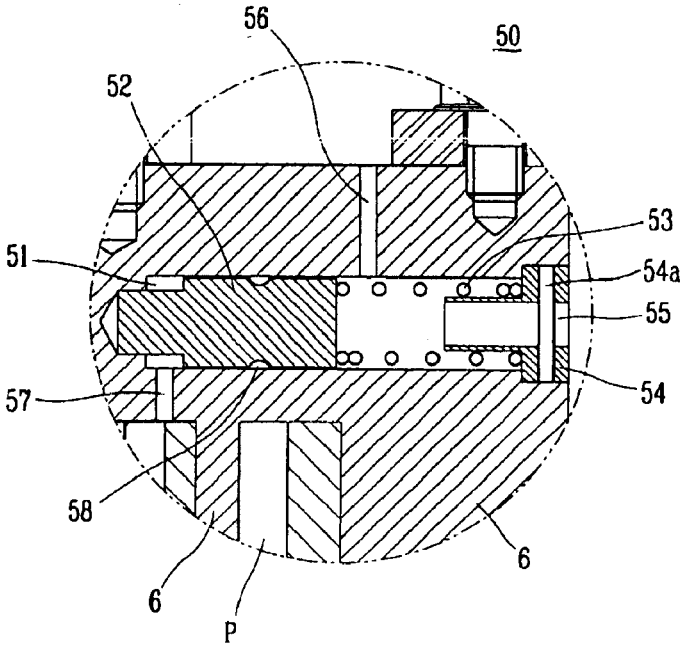
FIG. 9 is a longitudinal sectional view showing an operation of the vacuum preventing device when the compressor of FIG. 6 is abnormally driven.

FIG. 5 is a longitudinal sectional view showing a scroll compressor according the the present invention, FIG. 6 is a longitudinal sectional view showing an operation of the vacuum preventing device when the compressor of FIG. 5 is normally driven, FIG. 7 is an enlargement view showing a clearance close state of FIG. 6, FIG. 8 is a sectional view taken along line B—B of FIG. 6, and FIG. 9 is a longitudinal sectional view showing an operation of the vacuum preventing device when the compressor of FIG. 6 is abnormally driven.

As shown, the vacuum preventing device 50 for a scroll compressor according to one preferred embodiment of the present invention comprises: a chamber 51 formed at one side of a fixed scroll 6 and having a suction hole 55, a compression hole 57, and a discharge hole 56 at an inner circumference surface thereof; an open/close member 52 installed in the chamber 51 and having a seal oil groove 58 at an outer circumference surface thereof for selectively connecting the discharge hole 56 to the suction hole; and a spring 53 installed in the chamber 51 for providing an elasticity force to the open/close member 52.

The vacuum preventing device 50 is installed to solve a vacuum of the compressor generated at the time of a pump down and an expansion valve blocking.

More specifically, the vacuum preventing device 50 includes a chamber 51 formed at one side of the fixed scroll 6; and a discharge hole 56 connected to a discharge region S2 at an upper surface of the chamber 51.

A compression hole 57 connected to a compression region S3 is formed at a bottom surface of the chamber 51, a plug 54 having a suction hole 55 is fixed to an opening portion of the chamber 51 by a fixation pin 54*a*, and the suction hole 55 is connected to the discharge hole 56.

The open/close member 52 for selectively connecting the discharge hole 56 and the suction hole 55 is movably installed in the chamber 51.

The spring 53 for limiting a movement of the open/close member 52 and providing an elasticity force to the open/close member 52 is installed at the opening portion of the chamber 51.

When the compressor is normally driven, a pressure of the discharge region S2 is increased and the open/close member 52 of the chamber 51 receives a pressure downwardly through the discharge hole 56 connected to the discharge region S2. At this time, the clearance t between an inner upper surface of the chamber 51 and an upper surface of the open/close member 52 becomes large, thereby generating gas leakage through the clearance and having many problems.

To solve said problem, in the vacuum preventing device 50, a seal oil groove 58 is formed at an outer circumference surface of the open/close member 52 and oil 60 is always injected to the seal oil groove 58, thereby efficiently preventing gas leakage from the clearance t.

Even if the seal oil groove 58 can be formed as various shapes, it is preferable that the seal oil groove has a longitudinal sectional surface of a hemispheric shape so that a lot much oil 60 can remain in the seal oil groove 58.

A pressure through the discharge hole 56 at the time of a normal driving is a high pressure, so that the discharge hole 56 has to be closed by even force to efficiently prevent gas leakage.

To this end, in the vacuum preventing device, the seal oil groove 58 is formed at a due center of a contact portion between the inner wall of the chamber 51 and the open/close member 52.

In the vacuum preventing device, a width I of the seal oil groove can be formed identically to that D of the discharge hole but preferably formed more largely.

That is, the gas leakage is more efficiently closed by forming the oil 60 injected to the seal oil groove 58 more widely than the discharge hole 56.

Figure 10:
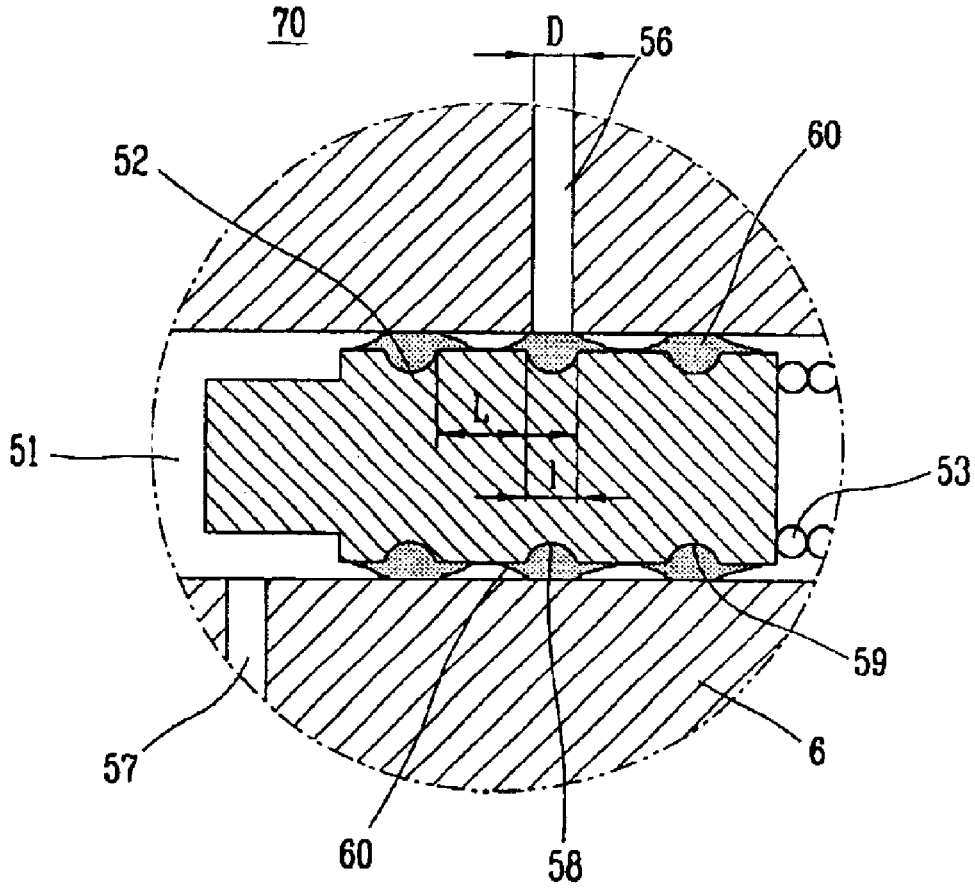
FIG. 10 is a longitudinal sectional view showing a vacuum preventing device for a scroll compressor according to another embodiment of the present invention.

FIG. 10 is a longitudinal sectional view showing a vacuum preventing device for a scroll compressor according to another embodiment of the present invention.

As shown, in the vacuum preventing device 70 according to another embodiment of the present invention, a plurality of seal oil grooves 59 can be formed at both sides of the seal oil groove 58 with a predetermined distance. At this time, the predetermined distance L between the respective seal oil grooves 58 and 59 can be equal to the width D of the discharge hole, but preferably larger than that.

Hereinafter, the operation and effects of the vacuum preventing device according to the one preferred embodiment of the present invention will be explained.

As aforementioned, as the orbiting scroll 5 orbits by the driving motor 3, gas in the suction region S1 is sucked, compressed in the compression space P, and discharged to the discharge region S2.

When the compressor is normally driven, a pressure of the compression region S3 is larger than an elasticity force of the spring 53, so that the open/close member 52 overcomes the elasticity force of the spring 53 and closes the discharge hole 56.

On the contrary, when the compressor is abnormally driven, a pressure of the compression region S3 is smaller than the elasticity force of the spring 53, so that the open/close member 52 is shoved by the elasticity force of the spring 53 and opens the discharge hole 56. At this time, the discharge hole 56 is connected to the suction hole 55 each other.

As the discharge hole 56 and the suction hole 55 is connected to each other, gas in the discharge region S2 flows backward to the suction region S1 through the discharge hole 56 and the suction hole 55, thereby releasing a vacuum of the compressor.

As aforementioned, when the compressor is normally driven, a pressure of the compression space P is introduced into the compression hole 57 and is applied to the open/close member 52. At this time, the open/close member 52 overcomes the elasticity of the spring 53 and slides, thereby closing the discharge hole 56.

In a state that the open/close member 52 closes the discharge hole 56, a discharge pressure is applied not only to the discharge hole 56 but also to adjacent portions.

In the conventional art, the clearance t is generated by the discharge pressure and gas in the discharge region leaks through the clearance t.

In the vacuum preventing device according to the one preferred embodiment of the present invention, the seal oil groove 58 is formed at an outer circumference surface of the open/close member 52 so as to prevent gas leakage, and the oil 60 is always injected to the seal oil groove 58, so that the oil 60 closes the clearance t and thereby prevents gas leakage efficiently.

As aforementioned, in the present invention, at the time of a normal driving, gas leakage is efficiently prevented from the clearance, thereby enhancing the compression efficiency of the compressor. Also, a design is improved and a tolerance limit range for the clearance is enhanced, thereby reducing a fabricating cost and improving a productivity.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A vacuum preventing device for a scroll compressor comprising:

a chamber formed at one side of a fixed scroll and having a suction hole, a compression hole, and a discharge hole that is located at an inner circumference surface thereof;

an open/close member installed in the chamber and having a seal oil groove at an outer circumference surface thereof for selectively connecting the discharge hole to the suction hole; and an elasticity member installed in the chamber for providing an elasticity force to the open/close member; and wherein at the time of a normal driving, oil injected to the seal oil groove closes a clearance between an inner wall of the chamber and the open/close member.

2. The device of claim 1, wherein the open/close member can contact the inner wall of the chamber over a predetermined length of the open/close member and the seal oil groove is located in the open/close member at about the center of that predetermined length.

3. The device of claim 2, wherein a plurality of oil seal grooves are formed at both sides of the seal oil groove with a predetermined distance between the respective grooves.

4. The device of claim 1, wherein at the time of a normal driving, the discharge hole is positioned at about the center of the predetermined length of the open/close member.

5. The device of claim 1, wherein the seal oil groove has a sectional surface of a hemispheric shape.

6. The device of claim 1, wherein the elasticity member is a spring.

7. A vacuum preventing device for a scroll compressor comprising:

a chamber formed at one side of a fixed scroll and having a suction hole, a compression hole, and a discharge hole that is located at an inner circumference surface thereof;

an open/close member installed in the chamber and having a seal oil groove at an outer circumference surface thereof for selectively connecting the discharge hole to the suction hole; and an elasticity member installed in the chamber for providing an elasticity force to the open/close member;

wherein the open/close member can contact the inner wall of the chamber over a predetermined length of the open/close member and the seal oil groove is located in the open/close member at about the center of that predetermined length;

wherein a plurality of seal oil grooves are formed at both sides of the seal oil groove with a predetermined distance between the respective grooves; and wherein the predetermined distance between the respective seal oil grooves is larger than a width of the discharge hole.

8. A vacuum preventing device for a scroll compressor comprising:

a chamber formed at one side of a fixed scroll and having a suction hole, a compression hole, and a discharge hole that is located at an inner circumference surface thereof;

an open/close member installed in the chamber and having a seal oil groove at an outer circumference surface thereof for selectively connecting the discharge hole to the suction hole; and an elasticity member installed in the chamber for providing an elasticity force to the open/close member;

wherein the open/close member can contact the inner wall of the chamber over a predetermined length of the open/close member and the seal oil groove is located in the open/close member at about the center of that predetermined length;

wherein a plurality of seal oil grooves are formed at both sides of the seal oil groove with a predetermined distance between the respective grooves; and wherein the predetermined distance between the respective seal oil grooves is identical to a width of the discharge hole.

9. A vacuum preventing device for a scroll compressor comprising:

a chamber formed at one side of a fixed scroll and having a suction hole, a compression hole, and a discharge hole that is located at an inner circumference surface thereof;

an open/close member installed in the chamber and having a seal oil groove at an outer circumference surface thereof for selectively connecting the discharge hole to the suction hole; and an elasticity member installed in the chamber for providing an elasticity force to the open/close member; and wherein the seal oil groove has a width that is larger than the discharge hole width.

10. A vacuum preventing device for a scroll compressor comprising:

a chamber formed at one side of a fixed scroll and having a suction hole, a compression hole, and a discharge hole that is located at an inner circumference surface thereof;

an open/close member installed in the chamber and having a seal oil groove at an outer circumference surface thereof for selectively connecting the discharge hole to the suction hole; and an elasticity member installed in the chamber for providing an elasticity force to the open/close member; and wherein the seal oil groove has a width that is identical to the discharge hole width.

* * * * *